US007900917B2

(12) United States Patent
Fujiwara et al.

(10) Patent No.: US 7,900,917 B2
(45) Date of Patent: Mar. 8, 2011

(54) RECORDING MEDIUM CONVEYER CAPABLE OF EFFECTIVELY CONVEYING RECORDING MEDIUM OF VARIOUS TYPES

(75) Inventors: Hiroshi Fujiwara, Ikeda (JP); Mizuna Tanaka, Ikeda (JP); Tomoyoshi Yamazaki, Minoo (JP); Toshikane Nishii, Ikeda (JP); Kazuyoshi Kondo, Toyonaka (JP); Haruyuki Honda, Minoo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/458,666

(22) Filed: Jul. 20, 2009

(65) Prior Publication Data

US 2010/0019440 A1 Jan. 28, 2010

(30) Foreign Application Priority Data

Jul. 28, 2008 (JP) ..... 2008-193395

(51) Int. Cl.
*B65H 7/02* (2006.01)

(52) U.S. Cl. ..... 271/265.04; 271/10.12; 271/10.13; 271/228

(58) Field of Classification Search ..... 271/265.04
See application file for complete search history.

(56) References Cited

U.S. PATENT DOCUMENTS

| | | | | |
|---|---|---|---|---|
| 6,508,465 | B1 * | 1/2003 | Endo | 271/265.04 |
| 7,806,401 | B2 * | 10/2010 | Fukao | 271/10.03 |
| 2006/0214355 | A1 * | 9/2006 | Fukao | 271/10.11 |

FOREIGN PATENT DOCUMENTS

| | | |
|---|---|---|
| JP | 07-157147 | 6/1995 |
| JP | 11-030884 | 2/1999 |
| JP | 3741191 | 11/2005 |
| JP | 2006-111423 | 4/2006 |

OTHER PUBLICATIONS

Abstract of JP 2001-097601 published on Apr. 10, 2001.

* cited by examiner

*Primary Examiner* — Stefanos Karmis
*Assistant Examiner* — Gerald W McClain
(74) *Attorney, Agent, or Firm* — Harness, Dickey & Pierce, P.L.C.

(57) ABSTRACT

In a recording medium conveyer, a driver drives a feeding member and a conveying member provided downstream from the feeding member in a recording medium conveyance direction independently. A controller stops driving the feeding member when a first time period elapses after a recording medium reaches the conveying member. When a selector judges that the thickness of the recording medium identifies the recording medium as thin paper, the controller does not drive the feeding member after the controller starts driving the conveying member, and when the selector judges that the recording medium has a thickness greater than a thickness of the recording medium that identifies the recording medium as thin paper, the controller restarts driving the feeding member no later than when the controller starts driving the conveying member.

4 Claims, 7 Drawing Sheets

RECORDING MEDIUM CONVEYER CAPABLE OF EFFECTIVELY CONVEYING RECORDING MEDIUM OF VARIOUS TYPES

PRIORITY STATEMENT

The present patent application claims priority from Japanese Patent Application No. 2008-193395, filed on Jul. 28, 2008, in the Japan Patent Office, the entire contents of which are hereby incorporated herein by reference.

BACKGROUND OF THE INVENTION

1. Field of the Invention

Example embodiments generally relate to a recording medium conveyer, and more particularly, to a recording medium conveyer for conveying a recording medium, for example.

2. Description of the Related Art

Related-art image forming apparatuses, such as copiers, facsimile machines, printers, or multifunction printers having at least one of copying, printing, scanning, and facsimile functions, typically form an image on a recording medium (e.g., a sheet) according to image data. Thus, for example, an image forming device forms an image according to the image data. A recording medium conveyer then sends a sheet from a paper tray toward an image transfer portion at which the image formed by the image forming device is transferred onto the sheet. In the recording medium conveyer, a separator including a feed roller and a separation pad separates an uppermost sheet from other sheets loaded in the paper tray by friction and feeds the uppermost sheet toward a registration roller pair. The registration roller pair feeds the sheet toward the image transfer portion.

In such image forming apparatus, friction applied to the sheet by the feed roller and the separation pad to forward the sheet may skew the sheet as it moves. Consequently, the sheet may be jammed in the image forming apparatus or the image may not be transferred at the proper position on the sheet. In order to correct such skew of the sheet, the sheet is contacted and stopped by the registration roller pair so that the sheet is bent between a nip portion formed between the feed roller and the separation pad and a nip portion formed by the registration roller pair.

In one example recording medium conveyer, an intermediate conveying roller pair is provided between the feed roller and the registration roller pair. After a sheet fed by the feed roller is bent when contacted and stopped by the registration roller pair, the registration roller pair starts rotating and the intermediate conveying roller stops rotating. The rotating registration roller pair rotates the intermediate conveying roller via the sheet to apply tension backward to the sheet, so as to correct skew of the sheet and prevent creasing of the sheet.

Increasing demand for more compact image forming apparatuses requires omission of the intermediate conveying roller pair and location of the paper tray directly under the image forming device. Accordingly, the sheet fed by the feed roller turns substantially before reaching the registration roller pair. Further, a sufficient space for absorbing bending of the sheet may not be provided. Consequently, skew of the sheet may not be corrected or the sheet nipped and bent between the nip portion formed between the feed roller and the separation pad and the nip portion formed by the registration roller pair may be twisted. When the sheet is thin paper, the twisted sheet may be creased.

On the other hand, in order to handle different types of sheets of varying thicknesses, such as thin paper and thick paper, another example image forming apparatus includes one motor for driving the feed roller and another, separate motor for driving the registration roller pair. This arrangement controls the feed roller so that the feed roller rotates at a speed faster than a speed of the registration roller pair, or continues driving the feed roller after driving the registration roller pair.

Although the above-described configuration can accommodate different types of sheets of varying thicknesses, it is known that a thin sheet is conveyed at a speed faster than a speed at which a thick sheet is conveyed because the thin sheet and the thick sheet have different slip rates of the sheet slipping on the feed roller. Accordingly, the thin sheet may be bent substantially between the nip portion formed between the feed roller and the separation pad and the nip portion formed by the registration roller pair. Consequently, the thin sheet may be twisted and creased or skew of the thin sheet may not be corrected.

SUMMARY

At least one embodiment may provide a recording medium conveyer that includes a feeding member, a conveying member, a driver, a drive transmission member, a selector, and a controller. The feeding member feeds a recording medium. The conveying member is provided downstream from the feeding member in a recording medium conveyance direction. The driver drives the feeding member and the conveying member independently. The drive transmission member is connected to the driver to transmit a driving force generated by the driver to the feeding member and the conveying member. The selector judges a thickness of the recording medium to be fed by the feeding member. The controller stops driving the feeding member when a first time period elapses after the recording medium reaches the conveying member. The conveying member conveys the recording medium fed by the feeding member to an image transfer portion at the same time an image is transferred onto the recording medium. When the selector judges that the thickness of the recording medium identifies the recording medium as thin paper, the controller does not drive the feeding member after the controller starts driving the conveying member, and when the selector judges that the recording medium has a thickness greater than a thickness of the recording medium that identifies the recording medium as thin paper, the controller restarts driving the feeding member no later than when the controller starts driving the conveying member.

At least one embodiment may provide a recording medium conveyer that includes a feeding member, a conveying member, a driver, a drive transmission member, a selector, and a controller. The feeding member feeds a recording medium. The conveying member is provided downstream from the feeding member in a recording medium conveyance direction. The driver drives the feeding member and the conveying member independently. The drive transmission member is connected to the driver to transmit a driving force generated by the driver to the feeding member and the conveying member. The selector judges a thickness of the recording medium to be fed by the feeding member. The controller stops driving the feeding member when a first time period elapses after the recording medium reaches the conveying member. The conveying member conveys the recording medium fed by the feeding member to an image transfer portion at the same time an image is transferred onto the recording medium. When the selector judges that the thickness of the recording medium identifies the recording medium as thin paper, the controller restarts driving the feeding member when a second time period elapses after the controller starts driving the conveying member, and when the selector judges that the recording medium has a thickness greater than a thickness of the recording medium that identifies the recording medium as thin paper, the controller restarts driving the feeding member no later than when the controller starts driving the conveying member.

At least one embodiment may provide a recording medium conveyer that includes a feeding member, a conveying member, a first driver, a second driver, a selector, and a controller. The feeding member feeds a recording medium. The conveying member is provided downstream from the feeding member in a recording medium conveyance direction. The first driver drives the feeding member. The second driver drives the conveying member. The selector judges a thickness of the recording medium to be fed by the feeding member. The controller stops driving the feeding member when a first time period elapses after the recording medium reaches the conveying member. The conveying member conveys the recording medium fed by the feeding member to an image transfer portion at the same time an image is transferred onto the recording medium. When the selector judges that the thickness of the recording medium identifies the recording medium as thin paper, the controller drives the feeding member again after the controller starts driving the conveying member at a first feeding speed slower than a conveying speed at which the conveying member conveys the recording medium, and when the selector judges that the recording medium has a thickness greater than a thickness of the recording medium that identifies the recording medium as thin paper, the controller drives the feeding member again at one of a second feeding speed identical to the conveying speed at which the conveying member conveys the recording medium and a third feeding speed faster than the conveying speed at which the conveying member conveys the recording medium.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
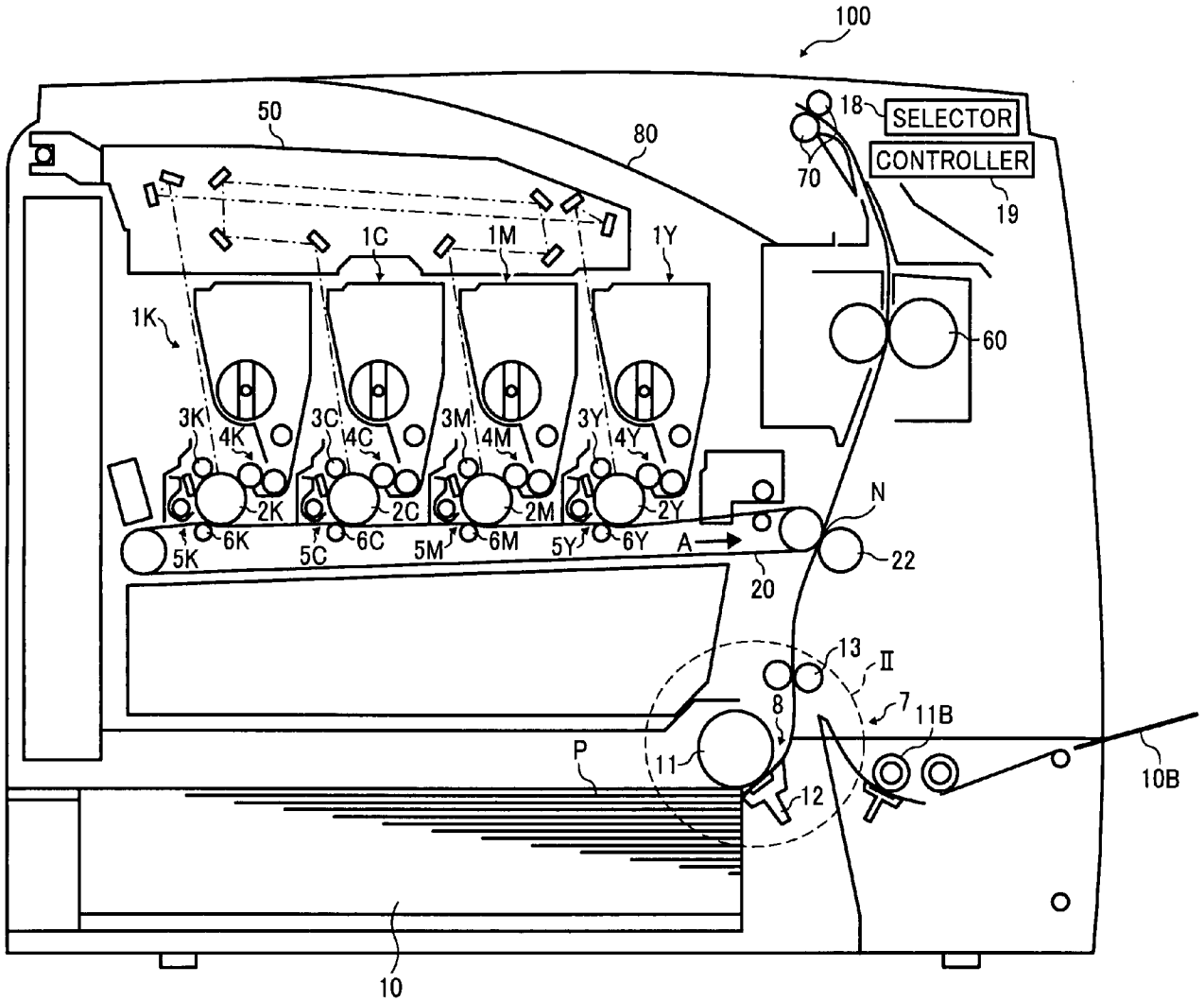
FIG. 1 is a schematic view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms a "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 100 according to an example embodiment is explained.

As illustrated in FIG. 1, the image forming apparatus 100 includes image forming units 1Y, 1M, 1C, and 1K, an intermediate transfer belt 20, transfer rollers 6Y, 6M, 6C, and 6K, an exposure device 50, a paper tray 10, a bypass tray 10B, a bypass tray feed roller 11B, a recording medium conveyer 7, a second transfer roller 22, a fixing device 60, an output roller pair 70, and/or an output tray 80.

The image forming units 1Y, 1M, 1C, and 1K include photoconductive drums 2Y, 2M, 2C, and 2K, chargers 3Y, 3M, 3C, and 3K, development devices 4Y, 4M, 4C, and 4K, and/or cleaners 5Y, 5M, 5C, and 5K, respectively.

The recording medium conveyer 7 includes a separator 8, a registration roller pair 13, a selector 18, and/or a controller 19. The separator 8 includes a feed roller 11 and/or a separation pad 12.

The image forming apparatus 100 can be a copier, a printer, a facsimile machine, a multifunction printer having at least one of copying, printing, scanning, plotter, and facsimile functions, or the like. According to this example embodiment of the present invention, the image forming apparatus 100 functions as a color printer for forming a color image on a recording medium by electrophotography.

The four image forming units 1Y, 1M, 1C, and 1K are arranged in a center portion of the image forming apparatus 100, and form yellow, magenta, cyan, and black toner images by using yellow, magenta, cyan, and black toners, respectively. The intermediate transfer belt 20 is looped over a plurality of support rollers and is provided under the image forming units 1Y, 1M, 1C, and 1K to extend in a horizontal direction. One of the plurality of support rollers rotated by a driver rotates the intermediate transfer belt 20 counterclockwise in FIG. 1 in a direction A. The transfer rollers 6Y, 6M, 6C, and 6K, serving as first transfer members, respectively, oppose the photoconductive drums 2Y, 2M, 2C, and 2K via the intermediate transfer belt 20.

The image forming units 1Y, 1M, 1C, and 1K have an identical structure and perform identical operations. In the image forming units 1Y, 1M, 1C, and 1K, the chargers 3Y, 3M, 3C, and 3K, the development devices 4Y, 4M, 4C, and 4K, and the cleaners 5Y, 5M, 5C, and 5K surround the photoconductive drums 2Y, 2M, 2C, and 2K, serving as image carriers, respectively, in this order clockwise in FIG. 1. The exposure device 50 is provided above the photoconductive drums 2Y, 2M, 2C, and 2K. The photoconductive drums 2Y, 2M, 2C, and 2K rotate clockwise in FIG. 1. The chargers 3Y, 3M, 3C, and 3K uniformly charge surfaces of the photoconductive drums 2Y, 2M, 2C, and 2K, respectively, to have a reference polarity. The exposure device 50 emits optically modulated laser beams onto the charged surfaces of the photoconductive drums 2Y, 2M, 2C, and 2K to form electrostatic latent images on the photoconductive drums 2Y, 2M, 2C, and 2K, respectively. The development devices 4Y, 4M, 4C, and 4K supply yellow, magenta, cyan, and black toners to the electrostatic latent images to make the electrostatic latent images visible as yellow, magenta, cyan, and black toner images, respectively. The yellow, magenta, cyan, and black toner images are sequentially transferred and superimposed onto the intermediate transfer belt 20 to form a color toner image on the intermediate transfer belt 20.

The paper tray 10, serving as a recording medium container, loads transfer sheets P serving as a recording medium. The feed roller 11, serving as a feeding member, feeds the transfer sheets P from the paper tray 10 toward the registration roller pair 13 serving as a conveying member. For example, the feed roller 11 and the separation pad 12, serving as a separation member, apply friction to the transfer sheets P to feed the transfer sheets P one by one toward the registration roller pair 13. Alternatively, the bypass tray feed roller 11B may feed a transfer sheet P inserted in the bypass tray 10B toward the registration roller pair 13.

The transfer sheet P contacted and temporarily stopped by the registration roller pair 13 is fed by the registration roller pair 13 to a second transfer portion N, serving as an image transfer portion, at which the second transfer roller 22 contacts the intermediate transfer belt 20 at a desired time at which the color toner image formed on the intermediate transfer belt 20 is properly transferred onto a transfer position on the transfer sheet P. For example, a voltage having a polarity opposite to a polarity of the color toner image is applied to the second transfer roller 22 so that the second transfer roller 22 transfers the color toner image formed on the intermediate transfer belt 20 onto the transfer sheet P. The transfer sheet P bearing the color toner image is sent to the fixing device 60. The fixing device 60 applies heat and pressure to the transfer sheet P bearing the color toner image to fix the color toner image on the transfer sheet P. The transfer sheet P bearing the fixed color toner image is sent to the output roller pair 70. The output roller pair 70 discharges the transfer sheet P onto the output tray 80.

Figure 2:
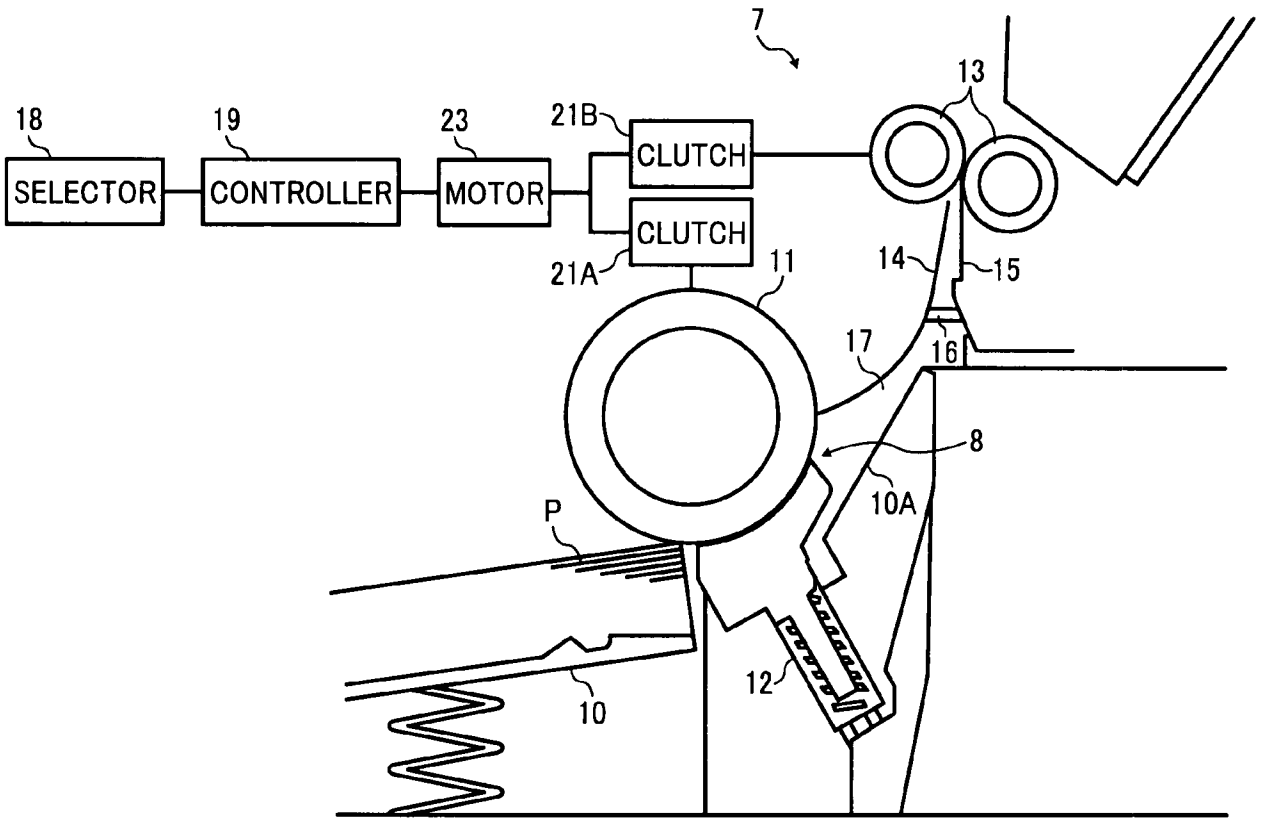
FIG. 2 is a schematic view (according to an example embodiment) of a recording medium conveyer included in the image forming apparatus shown in FIG. 1.

Referring to FIGS. 1 and 2, the following describes a relation between the feed roller 11 serving as a feeding member and the registration roller pair 13 serving as a conveying member. FIG. 2 is a schematic view of the recording medium conveyer 7, that is, a feeding portion indicated by a circle II shown in a dotted line in FIG. 1. As illustrated in FIG. 2, the recording medium conveyer 7 further includes an exit guide 10A, guides 14 and 15, a registration sensor 16, a conveyance path 17, clutches 21A and 21B, and/or a motor 23.

The paper tray 10 is provided in a lower portion of the image forming apparatus 100 depicted in FIG. 1. The rotating feed roller 11 and the separation pad 12 pressingly contacting the feed roller 11 separate an uppermost transfer sheet P from other transfer sheets P loaded in the paper tray 10. The exit guide 10A provided at an exit of the paper tray 10 and the guides 14 and 15 change a conveyance direction of the transfer sheet P to send the transfer sheet P to the registration roller pair 13. The separation pad 12 pressingly contacting the feed roller 11 separates the uppermost transfer sheet P from other transfer sheets P by friction, and therefore the transfer sheet P may slip on the feed roller 11. To address this, the feed roller 11 may feed the transfer sheet P at a speed faster than a speed at which the registration roller pair 13 feeds the transfer sheet P.

As illustrated in FIGS. 1 and 2, no roller serving as another conveying member, such as an intermediate conveying roller, is provided in the conveyance path 17 provided between the feed roller 11 and the registration roller pair 13. However, the exit guide 10A and the guides 14 and 15 are provided to guide the transfer sheet P sent from the paper tray 10 toward the registration roller pair 13. The conveyance path 17 provided with the exit guide 10A and the guides 14 and 15 can provide the compact image forming apparatus 100 and reduce parts included in the image forming apparatus 100, resulting in reduced manufacturing costs of the image forming apparatus 100.

As illustrated in FIGS. 1 and 2, a sending direction (e.g., a feeding direction) in which the feed roller 11 sends (e.g., feeds) the transfer sheet P from the paper tray 10 toward the registration roller pair 13 is different from a receiving direction in which the registration roller pair 13 receives the transfer sheet P sent (e.g., fed) by the feed roller 11. In other words, in the compact image forming apparatus 100, the conveyance path 17 turns along a curve of a small diameter circle, and an intermediate conveying roller is not provided in the conveyance path 17 provided between the feed roller 11 and the registration roller pair 13. Accordingly, the conveyance path 17 may have a smaller space for absorbing bending of the transfer sheet P than a conveyance path extending straight between the feed roller 11 and the registration roller pair 13. Consequently, the bent transfer sheet P may be creased. The following describes a structure of the image forming apparatus 100 to address this problem.

The registration sensor 16 is provided upstream from the registration roller pair 13 in a sheet conveyance direction to detect the transfer sheet P conveyed toward the registration roller pair 13. The registration sensor 16 may be an optical sensor, such as a reflection photo interrupter for detecting the transfer sheet P when the transfer sheet P cuts off light. Alternatively, the registration sensor 16 may be a mechanical sensor including a needle and a feeler provided in the conveyance path 17 to detect the transfer sheet P when the transfer sheet P sent by the feed roller 11 touches the feeler. Yet alternatively, the registration sensor 16 may be a combination of the optical sensor and the mechanical sensor for detecting the transfer sheet P when a light cut-off portion integrated with the feeler turns on and off a transmission photo interrupter.

After the registration sensor 16 detects a leading edge of the transfer sheet P sent by the feed roller 11, the leading edge of the transfer sheet P contacts the registration roller pair 13 which stops rotating. When the transfer sheet P is conveyed for a reference amount, the feed roller 11 stops rotating.

Figure 3A:
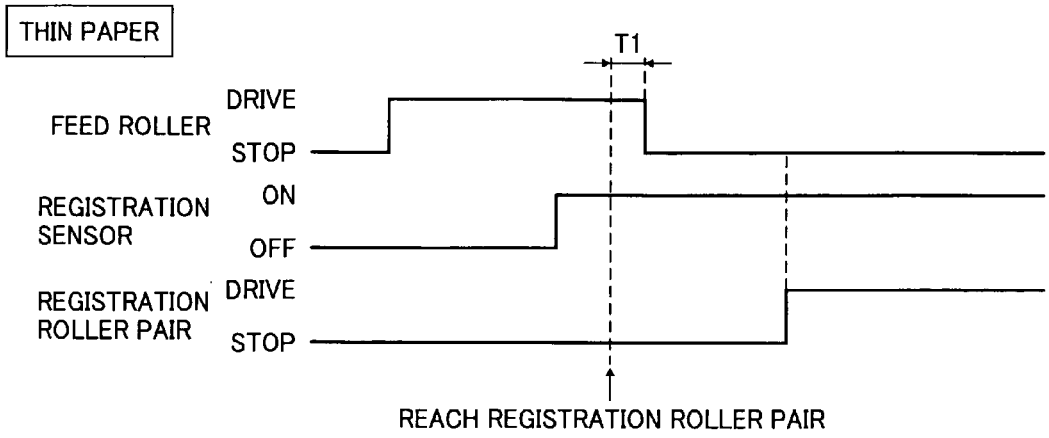
FIG. 3A is a timing chart (according to an example embodiment) illustrating a relation among operations of a feed roller, a registration sensor, and a registration roller pair included in the recording medium conveyer shown in FIG. 2 when a transfer sheet is thin paper.
Figure 3B:
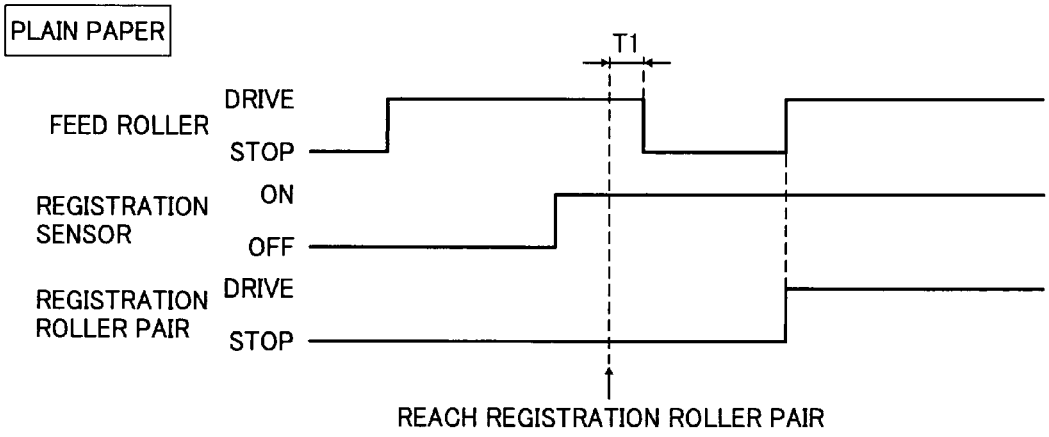
FIG. 3B is a timing chart (according to an example embodiment) illustrating a relation among operations of a feed roller, a registration sensor, and a registration roller pair included in the recording medium conveyer shown in FIG. 2 when a transfer sheet is plain paper.
Figure 3C:
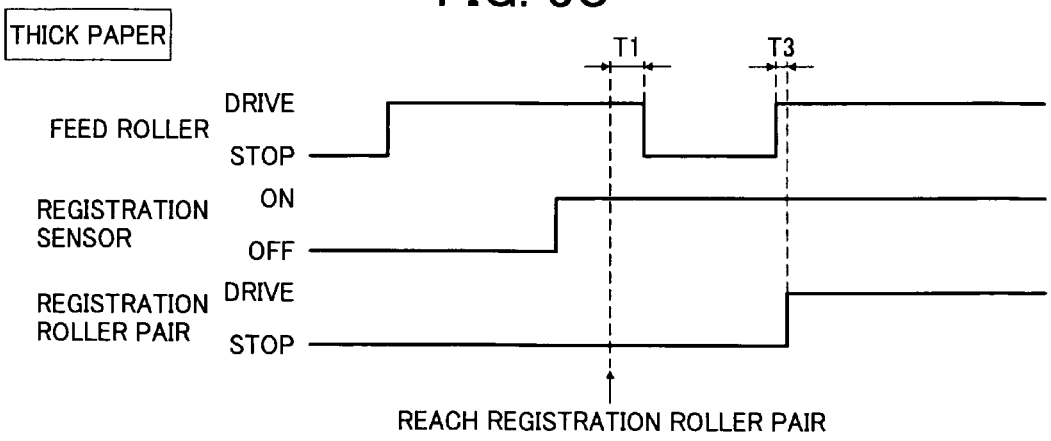
FIG. 3C is a timing chart (according to an example embodiment) illustrating a relation among operations of a feed roller, a registration sensor, and a registration roller pair included in the recording medium conveyer shown in FIG. 2 when a transfer sheet is thick paper.

FIG. 3A is a timing chart illustrating a relation among operations of the feed roller 11, the registration sensor 16, and the registration roller pair 13 depicted in FIG. 2 when a transfer sheet P is thin paper. FIG. 3B is a timing chart illustrating a relation among operations of the feed roller 11, the registration sensor 16, and the registration roller pair 13 when a transfer sheet P is plain paper (e.g., medium thickness paper). FIG. 3C is a timing chart illustrating a relation among operations of the feed roller 11, the registration sensor 16, and the registration roller pair 13 when a transfer sheet P is thick paper.

As illustrated in FIGS. 3A, 3B, and 3C, a time period T1 indicates a time period which begins after the transfer sheet P reaches (e.g., contacts) the registration roller pair 13 and ends when rotation (e.g., driving) of the feed roller 11 stops. According to this example embodiment, the time period T1 is set in such a manner that the transfer sheet P is fed for a feeding amount (e.g., about 3 mm) needed to correct skew of the transfer sheet P after the transfer sheet P contacts the registration roller pair 13. The time period T1 or the feeding amount needs to be set to an amount sufficient to correct skew of the transfer sheet P, and is determined based on feeding performance of the feed roller 11 serving as a feeding member, the structure of the conveyance path 17 provided between the feed roller 11 and the registration roller pair 13 serving as a conveying member, and the structure of the exit guide 10A and the guides 14 and 15 depicted in FIG. 2. For example, when the time period T1 is too short, skew of the transfer sheet P may not be corrected. By contrast, when the time period T1 is too long, the transfer sheet P is bent excessively. Consequently, when the transfer sheet P contacts the guides 14 and 15, noise may occur or the transfer sheet P may be folded. To address those problems, the time period T1 needs to be optimized by repeated experiments in a laboratory or repeated simulation, calculation for machine design, or combination of those. Therefore, the feeding amount (e.g., the time period T1) of the transfer sheet S may be either smaller or greater than 3 mm according to experimental results or a setting value determined for machine design.

As illustrated in FIG. 1, the selector 18 selects or judges thickness of the transfer sheet P. For example, when a user selects the thickness of the transfer sheet P (e.g., thick paper, plain paper, or thin paper) by using the selector 18, the controller 19 controls conveyance of the transfer sheet P according to the selected thickness of the transfer sheet P. In a low-end compact printer like the image forming apparatus 100, the selector 18 may be a switch on which the user selects the thickness of the transfer sheet P. For example, the selector 18 may be a mechanical switch, such as a dial switch or a push-button switch. Alternatively, the selector 18 may include electric signal buttons displayed on a control panel, such as a touch panel. Yet alternatively, other known switches may be used.

In a high-speed image forming apparatus used for production printing to print on a large volume of transfer sheets as well as in the compact printer, the selector 18 may be a sensor serving as a thickness detector for detecting the thickness of the transfer sheet P automatically, and the controller 19 may judge the thickness or type of the transfer sheet P based on the detected thickness. Such sensor for detecting the type of the transfer sheet P automatically can effectively prevent the user from forgetting selection of the thickness of the transfer sheet P or selecting the thickness of the transfer sheet P incorrectly.

Referring to FIGS. 2, 3A, 3B, and 3C, the following describes a conveyance control of the transfer sheet P according to an example embodiment. Plain paper or thick paper may be selected through the selector 18 for a transfer sheet P fed by the registration roller pair 13 to the second transfer portion N (depicted in FIG. 1) serving as an image transfer portion at which a toner image is transferred from the intermediate transfer belt 20 depicted in FIG. 1 onto the transfer sheet P. In this case, the transfer sheet P is contacted by the registration roller pair 13 and is bent to correct skew of the transfer sheet P. Accordingly, the separator 8 including the feed roller 11 and the separation pad 12 applies a greater friction load to plain paper or thick paper than to thin paper, and the exit guide 10A and the guides 14 and 15 contacting the transfer sheet P apply a greater sliding load to plain paper or thick paper than to thin paper. Consequently, a conveying speed of the registration roller pair 13 for conveying the transfer sheet P may not be stabilized. Change in the conveying speed of the transfer sheet P due to change in such loads applied to the conveyed transfer sheet P may generate shock jitter at the second transfer portion N and change in image density. In order to prevent or reduce shock jitter and change in image density, when plain paper or thick paper is selected through the selector 18 as the type of the transfer sheet P, the controller 19 starts driving the feed roller 11 in synchronism with start of driving of the registration roller pair 13 to decrease the loads applied to the conveyed transfer sheet P, as illustrated in FIG. 3B.

When thick paper, which is thicker than plain paper, is selected as the type of the transfer sheet P, the curved conveyance path 17 may cause the leading edge of the transfer sheet P to contact the registration roller pair 13 at an improper position. Further, thick paper may slip on the feed roller 11 for a greater amount than plain paper. Accordingly, the transfer sheet P may bend between the feed roller 11 and the registration roller pair 13 insufficiently. Consequently, when driving of the registration roller pair 13 starts, the registration roller pair 13 may grip or nip the transfer sheet P at a delayed time. To address this problem, the controller 19 starts driving the feed roller 11 in synchronism with start of driving of the registration roller pair 13 when the transfer sheet P is plain paper, as illustrated in FIG. 3B. However, when the transfer sheet P is thick paper, the controller 19 starts driving the feed roller 11 at a time by a time period T3 prior to start of driving of the registration roller pair 13, as illustrated in FIG. 3C, to provide an effect equivalent to an effect provided when the transfer sheet P is bent sufficiently.

As illustrated in FIG. 2, the controller 19 controls start of driving of the feed roller 11 and the registration roller pair 13 with the single motor 23 serving as a driver by turning on and off the clutches 21A and 21B, respectively. The clutch 21A (e.g., an electromagnetic clutch) serves as a drive transmission member connected to the feed roller 11 to drive the feed roller 11. The controller 19 turns on the clutch 21A to transmit a driving force generated by the motor 23 to the feed roller 11. Similarly, the clutch 21B (e.g., an electromagnetic clutch) serves as a drive transmission member connected to the registration roller pair 13 to drive the registration roller pair 13. The controller 19 turns on the clutch 21B to transmit a driving force generated by the motor 23 to the registration roller pair 13.

In addition to the feed roller 11 and the registration roller pair 13, the motor 23 drives other rollers for conveying a transfer sheet P, such as a fixing roller, the output roller pair 70 depicted in FIG. 1, and the bypass tray feed roller 11B depicted in FIG. 1. For example, a third clutch serving as a drive transmission member may be connected to the bypass tray feed roller 11B to drive the bypass tray feed roller 11B. The controller 19 may turn on the third clutch to transmit a driving force generated by the motor 23 to the bypass tray feed roller 11B.

The time to restart driving the feed roller 11 prior to start of driving of the registration roller pair 13, that is, the time period T3, is determined based on a condition in which the feed roller 11 serving as a feeding member applies a proper conveying force to the transfer sheet P to convey the transfer sheet P when the registration roller pair 13 serving as a conveying member starts being driven. For example, the time period T3 is calculated by adding a conveying force application time to a delay time calculated by adding a drive response time to a control response time. The control response time indicates a time period which begins after the motor 23 serving as a driver for driving the feed roller 11 receives a signal from the controller 19 and ends when the motor 23 starts driving the feed roller 11. The drive response time indicates a time period which begins after the motor 23 starts driving the feed roller 11 and ends when the feed roller 11 starts rotating. The conveying force application time indicates a time period which begins after the feed roller 11 starts rotating and ends when a conveying force applied by the feed roller 11 is transmitted to the transfer sheet P. The control response time, the drive response time, and the conveying force application time are determined based on experiments and simulation. In the image forming apparatus 100, the conveying force application time is in a range of about 20 milliseconds to about 50 milliseconds.

When thin paper is selected through the selector 18 as the type of the transfer sheet P, the transfer sheet S may not slip on the feed roller 11. Therefore, a bending amount of the transfer sheet P to correct skew of the transfer sheet P is set to about 3 mm. Further, when the controller 19 drives the feed roller 11 when the controller 19 starts driving the registration roller pair 13, a difference between rotation speed of the feed roller 11 and rotation speed of the registration roller pair 13 increases the bending amount of the transfer sheet P in the conveyance path 17 provided between the feed roller 11 and the registration roller pair 13 as the transfer sheet P is conveyed. The increased bending amount of the transfer sheet P presses the transfer sheet P against the exit guide 10A and the guides 14 and 15. Accordingly, the transfer sheet P may be creased or the transfer sheet P contacting the exit guide 10A and the guides 14 and 15 may increase noise caused by the conveyed transfer sheet P. Further, when the feed roller 11 skews the transfer sheet P, the transfer sheet P is twisted in the conveyance path 17 provided between the feed roller 11 and the registration roller pair 13, creasing the transfer sheet P.

To address this problem, according to this example embodiment, the controller 19 does not drive the feed roller 11 when the controller 19 starts driving the registration roller pair 13 when the transfer sheet P is thin paper, as illustrated in FIG. 3A. Accordingly, bending of the transfer sheet P is eliminated after the controller 19 starts driving the registration roller pair 13. After the elimination of bending of the transfer sheet P, the feed roller 11 rotates in accordance with conveyance of the transfer sheet P because the feed roller 11 is connected to and driven by the clutch 21A serving as a drive transmission member. Accordingly, even when the bent transfer sheet P is skewed and twisted, the twist of the transfer sheet P is eliminated when the bending of the transfer sheet P is eliminated. Further, the conveyed thin paper is applied with a smaller load. Therefore, even when the feed roller 11 rotates in accordance with conveyance of the transfer sheet P, shock jitter or change in image density may not occur at the second transfer portion N depicted in FIG. 1. Consequently, the above-described conveyance control can convey the transfer sheet P to form a toner image properly.

Referring to FIGS. 2, 4A, 4B, and 4C, the following describes a conveyance control of the transfer sheet P according to another example embodiment.

Figure 4A:
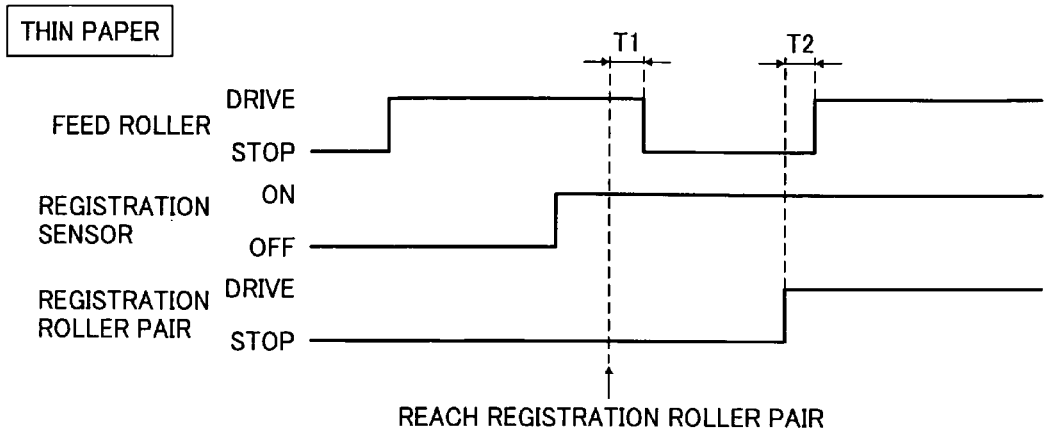
FIG. 4A is a timing chart illustrating a relation among operations of a feed roller, a registration sensor, and a registration roller pair included in the recording medium conveyer shown in FIG. 2 when a transfer sheet is thin paper according to another example embodiment.
Figure 4B:
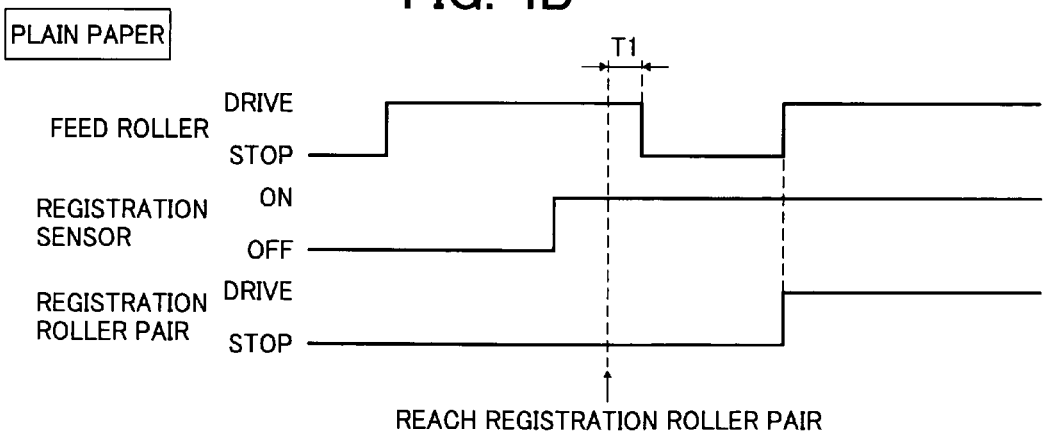
FIG. 4B is a timing chart (according to an example embodiment) illustrating a relation among operations of a feed roller, a registration sensor, and a registration roller pair included in the recording medium conveyer shown in FIG. 2 when a transfer sheet is plain paper.
Figure 4C:
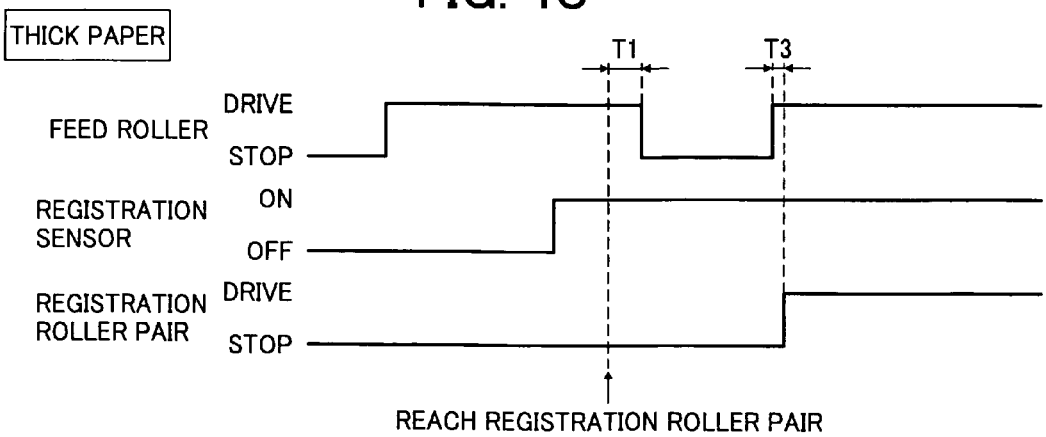
FIG. 4C is a timing chart (according to an example embodiment) illustrating a relation among operations of a feed roller, a registration sensor, and a registration roller pair included in the recording medium conveyer shown in FIG. 2 when a transfer sheet is thick paper.

FIG. 4A is a timing chart illustrating a relation among operations of the feed roller 11, the registration sensor 16, and the registration roller pair 13 depicted in FIG. 2 when a transfer sheet P is thin paper. FIG. 4B is a timing chart illustrating a relation among operations of the feed roller 11, the registration sensor 16, and the registration roller pair 13 when a transfer sheet P is plain paper. FIG. 4C is a timing chart illustrating a relation among operations of the feed roller 11, the registration sensor 16, and the registration roller pair 13 when a transfer sheet P is thick paper.

Like in the conveyance control of the transfer sheet P depicted in FIGS. 3A, 3B, and 3C, the controller 19 depicted in FIG. 2 drives the feed roller 11 for the time period T1 after a transfer sheet P reaches (e.g., contacts) the registration roller pair 13 to obtain the bending amount of the transfer sheet P for about 3 mm, for example. A difference between the conveyance control depicted in FIGS. 4A, 4B, and 4C and the conveyance control depicted in FIGS. 3A, 3B, and 3C is that the controller 19 controls driving of the feed roller 11 differently when thin paper is selected through the selector 18 depicted in FIG. 2.

According to the conveyance control depicted in FIG. 4A, when thin paper is selected through the selector 18, the controller 19 starts driving the feed roller 11 at a time delayed by a time period T2 after the controller 19 starts driving the registration roller pair 13. Like in the conveyance control depicted in FIGS. 3A, 3B, and 3C, the controller 19 controls start of driving of the feed roller 11 and the registration roller pair 13 with the single motor 23 by turning on and off the clutches 21A and 21B (e.g., electromagnetic clutches) depicted in FIG. 2, respectively. When start of driving of the feed roller 11 is delayed by the time period T2, a bending amount of the transfer sheet P in the conveyance path 17 (depicted in FIG. 2) provided between the feed roller 11 and the registration roller pair 13 is decreased slightly. Simultaneously, bending of the transfer sheet P is not eliminated completely and therefore the feed roller 11 and the registration roller pair 13 nipping the transfer sheet P do not stretch the transfer sheet P. Accordingly, a smaller sliding load is applied to the transfer sheet P sliding on the exit guide 10A and the guides 14 and 15 depicted in FIG. 2. Moreover, the transfer sheet P is not tensioned, preventing or reducing impact applied to the transfer sheet P.

When the controller 19 controls driving of the feed roller 11 as illustrated in FIGS. 4A, 4B, and 4C, the feed roller 11 conveys the transfer sheet P at a conveying speed faster than a conveying speed at which the registration roller pair 13 conveys the transfer sheet P. Accordingly, a bending amount of the transfer sheet P increases as the transfer sheet P is conveyed. However, when the controller 19 starts driving the feed roller 11, the registration roller 13 already rotating decreases the bending amount of the transfer sheet P to correct skew of the transfer sheet P. Consequently, the bending amount of the whole transfer sheet P is decreased enough to prevent the transfer sheet P from creasing. When a trailing edge of the transfer sheet P passes through the feed roller 11, the bending of the transfer sheet P caused by the difference between the conveying speed of the feed roller 11 and the conveying speed of the registration roller pair 13 is eliminated.

As described above, the conveyance control depicted in FIGS. 4A, 4B, and 4C provides an effect of preventing or reducing impact on the transfer sheet P in addition to the effect provided by the conveyance control depicted in FIGS. 3A, 3B, and 3C. The time period T1, that is, the time period in which the feed roller 11 conveys the transfer sheet P after the transfer sheet P reaches (e.g., contacts) the registration roller pair 13, may be not shorter than the time period T2 depicted in FIG. 4A. The time period T2 is set to prevent the bending amount of the transfer sheet P generated to correct skew of the transfer sheet P from increasing. Simultaneously, the time period T2 is set to prevent change in conveying load of the transfer sheet P applied to the registration roller pair 13. Therefore, the time period T2 is set to prevent a malfunction caused by excessive bending of the transfer sheet P in the conveyance path 17 provided between the feed roller 11 and the registration roller pair 13. Simultaneously, the time period T2 is set to prevent the bending of the transfer sheet P generated to correct skew of the transfer sheet P from being eliminated completely, and to prevent the feed roller 11 and the registration roller pair 13 nipping the transfer sheet P from stretching the transfer sheet P.

Figure 5A:
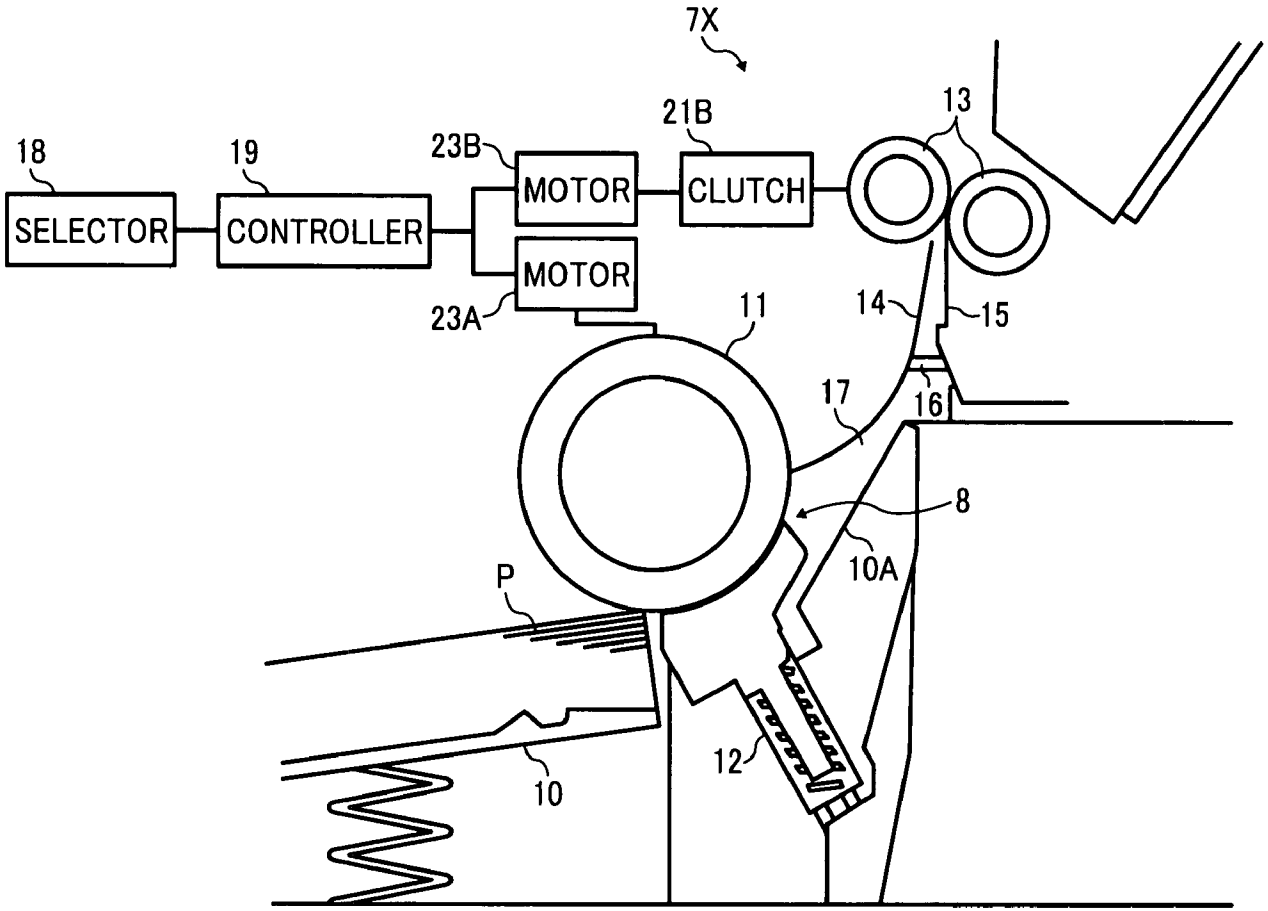
FIG. 5A is a schematic view of a recording medium conveyer according to yet another example embodiment.
Figure 5B:
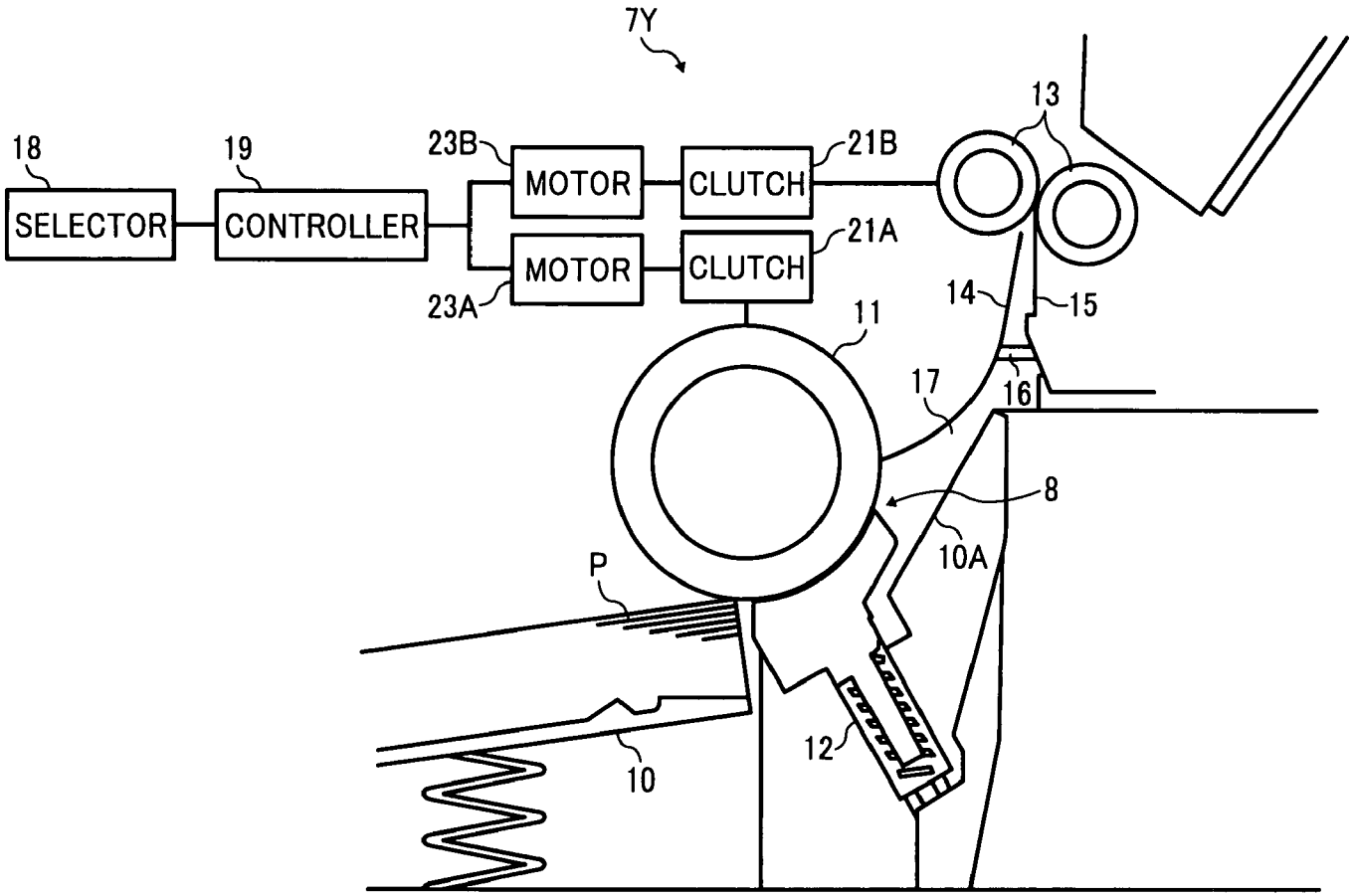
FIG. 5B is a schematic view of a recording medium conveyer according to yet another example embodiment.

Referring to FIGS. 5A, 5B, 6A, and 6B, the following describes recording medium conveyers 7X and 7Y according to yet another example embodiment. FIG. 5A is a schematic view of the recording medium conveyer 7X. The recording medium conveyer 7X includes motors 23A and 23B instead of the motor 23 depicted in FIG. 2 and does not include the clutch 21A depicted in FIG. 2. The other elements of the recording medium conveyer 7X are equivalent to the elements of the recording medium conveyer 7 depicted in FIG. 2. FIG. 5B is a schematic view of the recording medium conveyer 7Y. The recording medium conveyer 7Y includes the clutch 21A. The other elements of the recording medium conveyer 7Y are equivalent to the elements of the recording medium conveyer 7X depicted in FIG. 5A.

As illustrated in FIGS. 5A and 5B, the separate motors 23A and 23B serve as first and second drivers for driving the feed roller 11 serving as a feeding member and the registration roller pair 13 serving as a conveying member, respectively. Namely, the feed roller 11 is driven independently of the registration roller pair 13.

In the recording medium conveyer 7X illustrated in FIG. 5A, the controller 19 turns on the motor 23A to drive the feed roller 11. The clutch 21B (e.g., an electromagnetic clutch) serves as a drive transmission member connected to the registration roller pair 13 to drive the registration roller pair 13. The controller 19 turns on the clutch 21B to transmit a driving force generated by the motor 23B to the registration roller pair 13.

In addition to the registration roller pair 13, the motor 23B drives rollers for conveying a transfer sheet P other than the feed roller 11, such as a fixing roller and the output roller pair 70 depicted in FIG. 1. A third motor provided exclusively for the bypass tray feed roller 11B depicted in FIG. 1 drives the bypass tray feed roller 11B.

In the recording medium conveyer 7Y illustrated in FIG. 5B, the controller 19 turns on the clutch 21B to transmit a driving force generated by the motor 23B to the registration roller pair 13. The motor 23A drives the feed roller 11 and the bypass tray feed roller 11B depicted in FIG. 1. For example, the controller 19 turns on the clutch 21A to transmit a driving force generated by the motor 23A to the feed roller 11. The controller 19 turns on a third clutch to transmit a driving force generated by the motor 23A to the bypass tray feed roller 11B.

In addition to the registration roller pair 13, the motor 23B drives rollers for conveying a transfer sheet P other than the feed roller 11, such as a fixing roller and the output roller pair 70 depicted in FIG. 1.

Figure 6A:
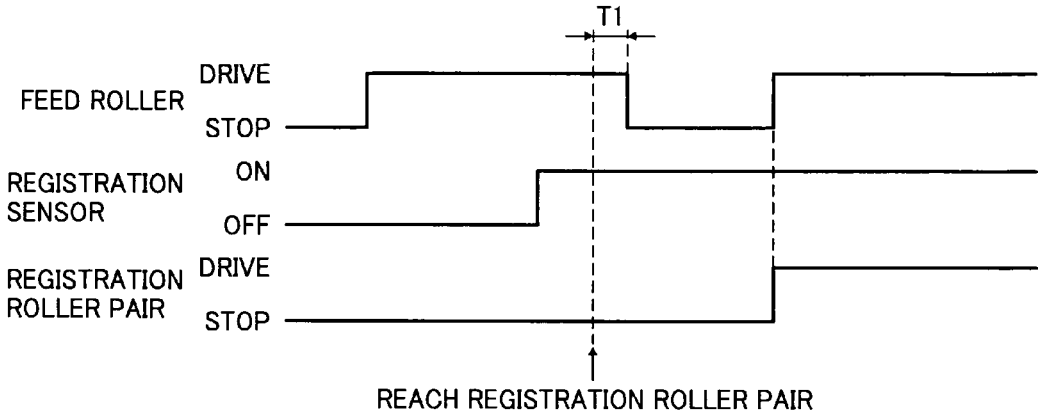
FIG. 6A is a timing chart (according to an example embodiment) illustrating a relation among operations of a feed roller, a registration sensor, and a registration roller pair included in the recording medium conveyer shown in FIGS. 5A and 5B.
Figure 6B:
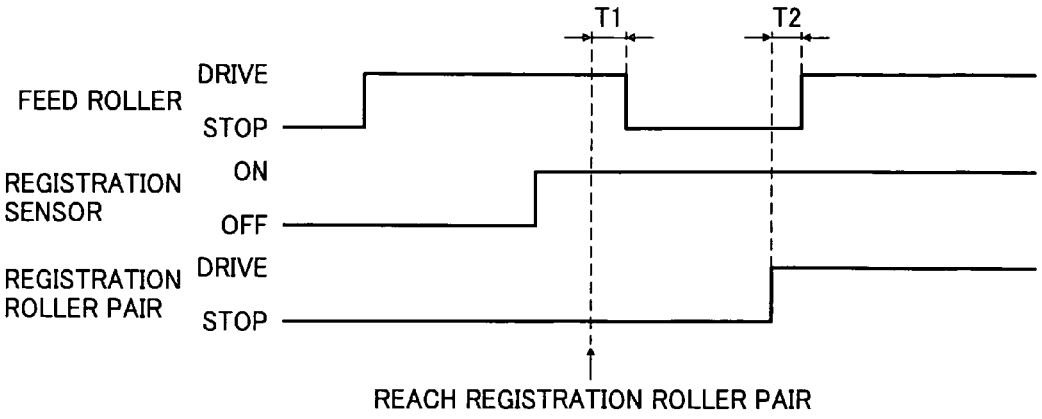
FIG. 6B is a timing chart (according to an example embodiment) illustrating another relation among operations of a feed roller, a registration sensor, and a registration roller pair included in the recording medium conveyer shown in FIGS. 5A and 5B.

FIG. 6A is a timing chart illustrating a relation among operations of the feed roller 11, the registration sensor 16, and the registration roller pair 13 depicted in FIGS. 5A and 5B. FIG. 6B is a timing chart illustrating another relation among operations of the feed roller 11, the registration sensor 16, and the registration roller pair 13.

Like in the above-described example embodiments shown in FIGS. 3A, 3B, 3C, 4A, 4B, and 4C, when a transfer sheet P reaches the registration roller pair 13, that is, when the transfer sheet P is contacted and stopped by the registration roller pair 13 which stops rotating, the feed roller 11 is driven to convey the transfer sheet P for a reference amount (e.g., about 3 mm) corresponding to the time period T1, so as to bend the transfer sheet P to correct skew of the transfer sheet P. Thereafter, the controller 19 depicted in FIGS. 5A and 5B stops rotating the feed roller 11. However, this example embodiment illustrated in FIG. 6A differs from the above-described example embodiments shown in FIGS. 3A, 3B, 3C, 4A, 4B, and 4C in that the controller 19 starts driving the feed roller 11 irrespective of thickness of the transfer sheet P in synchronism with start of driving of the registration roller pair 13 at a proper time when a toner image is transferred from the intermediate transfer belt 20 onto the transfer sheet P at the second transfer portion N depicted in FIG. 1.

When a conveying speed V1 indicates a speed at which the registration roller pair 13 conveys the transfer sheet P and a conveying speed V2 indicates a speed at which the feed roller 11 conveys the transfer sheet P, the conveying speed V2 of the feed roller 11 is not slower than the conveying speed V1 of the registration roller pair 13 when the transfer sheet P is thick paper or plain paper because the transfer sheet P may slip on the feed roller 11. By contrast, the conveying speed V2 of the feed roller 11 is slower than the conveying speed V1 of the registration roller pair 13 when the transfer sheet P is thin paper because the transfer sheet P may hardly slip on the feed roller 11.

The conveying speed V1 of the registration roller pair 13 and the conveying speed V2 of the feed roller 11 are adjusted by controlling a number of rotations of the independent motors 23A and 23B depicted in FIGS. 5A and 5B.

According to this example embodiment also, bending of the transfer sheet P generated to correct skew of the transfer sheet P can be adjusted to have a bending amount not creasing the transfer sheet P. However, when the transfer sheet P is thin paper, the conveying speed V2 of the feed roller 11 is slower than the conveying speed V1 of the registration roller pair 13. Accordingly, bending of the transfer sheet P may be eliminated completely before a trailing edge of the transfer sheet P passes through the feed roller 11, and the registration roller pair 13 may stretch the transfer sheet P. To address this problem, difference between the conveying speed V1 of the registration roller pair 13 and the conveying speed V2 of the feed roller 11 is adjusted properly.

With the structure illustrated in FIG. 5A or 5B, the conveyance control shown in FIG. 4A may be performed. For example, as illustrated in FIG. 6B, the controller 19 starts driving the feed roller 11 when the time period T2 elapses after the controller 19 starts driving the registration roller pair 13. In this case, a time to start driving the motor 23A for driving the feed roller 11 provided independent of the motor 23B for driving the registration roller pair 13 is controlled to adjust a time to start driving the feed roller 11.

In a recording medium conveyer (e.g., the recording medium conveyer 7 depicted in FIG. 2, the recording medium conveyer 7X depicted in FIG. 5A, or the recording medium conveyer 7Y depicted in FIG. 5B) according to the above-described example embodiments, a time to start driving a feeding member (e.g., the feed roller 11 depicted in FIGS. 2, 5A, and 5B) before or after starting driving a conveying member (e.g., the registration roller pair 13 depicted in FIGS. 2, 5A, and 5B) and/or a conveying speed at which the feeding member conveys a recording medium (e.g., a transfer sheet P depicted in FIGS. 2, 5A, and 5B) are properly controlled by selecting or judging thickness of the recording medium. Accordingly, the recording medium may not be creased due to an increased amount of bending of the recording medium. Further, the recording medium may not slip on a separator (e.g., the separator 8 depicted in FIGS. 2, 5A, and 5B) according to the thickness of the recording medium. Thus, the recording medium conveyer can handle various types of recording medium.

According to the above-described example embodiments, the recording medium conveyers 7, 7X, and 7Y include the feed roller 11. Alternatively, the recording medium conveyers 7, 7X, and 7Y may include the bypass tray feed roller 11B depicted in FIG. 1 instead of the feed roller 11.

The image forming apparatus 100 depicted in FIG. 1 may form an image in various methods. For example, the image forming apparatus 100 serving as a color image forming apparatus may include tandem image forming devices to form a color image in a direct transfer method. Alternatively, the image forming apparatus 100 may include a plurality of development devices surrounding a single image carrier. Yet alternatively, the image forming apparatus 100 may include a rotary development device.

Further, the image forming apparatus 100 may form a full-color image and/or a monochrome image. The devices included in the image forming apparatus 100, such as the fixing device 60 and the exposure device 50 depicted in FIG. 1, may have various structures.

The image forming apparatus 100 may form an image in various methods, such as an electrophotographic method and an inkjet method. Further, the image forming apparatus 100 may be a multifunction printer having at least one of copying, printing, scanning, and facsimile functions or the like.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A recording medium conveyer, comprising:

a feeding member to feed a recording medium;

a conveying member provided downstream from the feeding member in a recording medium conveyance direction;

a driver to drive the feeding member and the conveying member independently;

a drive transmission member connected to the driver to transmit a driving force generated by the driver to the feeding member and the conveying member;

a selector to judge a thickness of the recording medium to be fed by the feeding member; and a controller to stop driving the feeding member when a first time period elapses after the recording medium reaches the conveying member, the conveying member conveying the recording medium fed by the feeding member to an image transfer portion at the same time an image is transferred onto the recording medium, wherein, when the selector judges that the thickness of the recording medium identifies the recording medium as thin paper, the controller does not drive the feeding member after the controller starts driving the conveying member, and when the selector judges that the recording medium has a thickness greater than a thickness of the recording medium that identifies the recording medium as thin paper, the controller restarts driving the feeding member no later than when the controller starts driving the conveying member.

2. The recording medium conveyer according to claim 1, wherein a conveying speed at which the feeding member conveys the recording medium is faster than a conveying speed at which the conveying member conveys the recording medium.

3. The recording medium conveyer according to claim 1, further comprising:

a conveyance path provided between the feeding member and the conveying member; and a guide provided in the conveyance path to guide the recording medium conveyed in the conveyance path.

4. The recording medium conveyer according to claim 3, wherein the feeding member feeds the recording medium in a feeding direction and the conveying member receives the recording medium fed by the feeding member in a receiving direction that is different from the feeding direction.

* * * * *